US006192810B1

(12) United States Patent
Stallings et al.

(10) Patent No.: US 6,192,810 B1
(45) Date of Patent: Feb. 27, 2001

(54) LAMINAR FLOW AIR REGISTER

(75) Inventors: Kevin Jay Stallings; Jefferson Landers Shelton, both of Jacksonville; Kerry Dale Mackey, Glencoe, all of AL (US)

(73) Assignee: BTA Drayton, Jacksonville, AL (US)

( * ) Notice: Subject to any disclaimer, the term of this patent is extended or adjusted under 35 U.S.C. 154(b) by 0 days.

(21) Appl. No.: 09/307,469

(22) Filed: May 10, 1999

(51) Int. Cl.[7] ..... F23L 13/00; F23D 14/68

(52) U.S. Cl. ..... 110/182.5; 110/147; 110/310; 110/313; 110/314; 110/300; 110/297; 122/13.01; 239/590; 239/455

(58) Field of Search ..... 110/348, 347, 110/147, 182, 182.5, 301, 309, 310, 313, 314, 300, 297; 122/70, 13.01; 239/590 C, 455 C, 533.13, 265.43

(56) References Cited

U.S. PATENT DOCUMENTS 46,445 * 2/1865 Brown ..... 239/533.13
2,546,293 * 3/1951 Berliner ..... 60/35.5
2,625,008 * 1/1953 Crook ..... 60/35.6
3,580,512 * 5/1971 Smith ..... 239/432
4,425,855 * 1/1984 Chadshay ..... 110/263
5,127,581 * 7/1992 Kuwano et al. ..... 239/455
5,715,763 * 2/1998 Fornetti ..... 110/238
5,824,275 * 10/1998 Bitzer et al. ..... 422/184

* cited by examiner

*Primary Examiner*—Denise L. Ferensic
*Assistant Examiner*—K. B. Rinehart
(74) *Attorney, Agent, or Firm*—Robert J. Veal; Christopher A. Holland; Burr & Forman LLP

(57) ABSTRACT

A register for use in conjunction with kraft recovery boilers or bark-fired boilers utilizes a pair of shaped damper foils to reduce turbulence and induce laminar flow of air from an associated windbox through a port in the boiler. The foils are mounted for constant minimal separation from an exit nozzle to reduce transitional discontinuities which induce turbulence. A curved plenum is also provided to reduce internal turbulence within the plenum.

16 Claims, 3 Drawing Sheets

LAMINAR FLOW AIR REGISTER

BACKGROUND AND FIELD OF THE INVENTION

A recovery boiler is a furnace wherein a waste fuel and air are combusted and chemicals from the waste fuel is recovered. In the pulp and paper industry one such waste fuel is called black liquor, which comprises in part water and sodium sulfate ($Na_2SO_4$). The combustion of black liquor in a recovery boiler results, among other things, in a chemical process in which sodium sulfide ($Na_2S$) is recovered through the chemical reaction of the combustion process. In the pulp and paper industry, the recovery of sodium sulfide is essential to the paper manufacturer, inasmuch as the chemical is used in the chemical reaction to break the lignin of the fibers to produce pulp. For the pulp and paper industry then, the recovery boiler serves two functions, viz. an essential chemical of the paper producing process is produced from the recovery boiler, and a certain amount of energy is liberated for use to generate steam and/or electricity for use at the mill.

A recovery boiler comprises a fuel input, and a plurality of air inputs, a smelt output and an exhaust output. The air input, which is closest to the bed of the boiler in which air enters into the recovery boiler, is termed the primary air input. In the sequence of order of location of other air inputs into the boiler, the other air inputs into the boiler which are, in successive further distance away from the bed, termed secondary air inputs and tertiary air inputs, respectively. Fuel and air are primarily combusted in a zone which is located near the level of the secondary air input, and referred to as the oxidation zone. It has long been recognized that the primary air input is responsible for controlling the amount of air entering into the area just above the bed of the boiler, hence, for creating either a reducing atmosphere or an oxidizing atmosphere in the area just above the bed of the boiler (a reducing atmosphere being defined as an oxygen starved atmosphere; whereas, an oxidizing atmosphere is defined as an oxygen enriched atmosphere). The combustion of black liquor in a recovery boiler in a reducing atmosphere results in the following main chemical reaction:

$$2C+Na_2SO4 \sim 2CO2+Na_2S$$

The molten state of sodium sulfide ($Na_2S$) which is recovered from the bed of the boiler is termed smelt. It has been recognized that for this chemical reaction to take place, a reducing atmosphere should be maintained in the area just above the bed, hereafter referred to as the reduction zone. If there is too much primary air above the bed, then the reduction efficiency is decreased since an oxidation reaction instead of a reduction reaction will take place. Moreover, the heat released by the oxidation (combustion process) will primarily be used to raise the temperature of the excess amount of primary air. The raising of the temperature of the excess amount of primary air will cause a large upward draft of air. The upward draft will cause the liquor droplets to be retained longer before hitting the bed. The longer the liquor droplets remain in its flight, the more water in the liquor will evaporate and the combustion process will have to proceed further prior to the liquor droplets hitting the smelt bed. These effects will result in a gradually cooling surface temperature of the bed leading toward an eventual extinction of the fire. On the other hand, if too little primary air is supplied, the combustion process will not proceed causing the temperature in the smelt to decrease making it difficult to drain. The bed will then start building up, increasing the rate of cooling and rapidly extinguishing the fire. Hence, a very critical measure of the performance of this zone is the temperature above the bed.

Heretofore, one method of measuring the temperature above the bed is to take a direct measurement of the temperature of the bed through an optical pyrometer. While this direct approach is in theory the best, practical implementation of this approach has led to many difficulties due in part to (1) the temperature of the bed which is at an extremely high temperature, typically on the order of one thousand degrees centigrade (1000° C.) necessitating cooling means for the pyrometer; and (2) the dirty environment in which the pyrometer must operate, and thus, it is subject to reliability problems.

The main objective in recovery boilers is to dispose of a process waste material black liquor by burning the organic residue, thereby generating steam, and converting the inorganic chemicals to a reusable form. This is to be done while at the same time minimizing the carry-over of particulate matter and release of environmentally objectionable gases through the boiler's stack. There have been many attempts in the past to improve boiler efficiency by implementing complex control systems that affect airflow rate into the combustion chamber. Notable examples of this are shown in U.S. Pat. No. 4,362,269 issued to Rastogi on Dec. 7, 1982, and U.S. Pat. No. 4,359,950 issued to Leffler on Nov. 23, 1982. Both patents provide a good description of recovery boiler operation and recognize that boiler efficiency is affected by the control of air into the combustion chamber.

Most modern day recovery boilers have three levels where air, usually called "combustion air," is input to the boiler's furnace or combustion chamber. The lowest or primary level is at or near the same level as the burning bed. The mid or secondary level is positioned just above where the top of the burning bed would normally be located if the boiler were operating at optimum design capacity. The upper or tertiary level is located above the normal position where fuel guns deliver black liquor fuel into the combustion chamber. Some, but not all, older recovery boilers employ only two levels of combustion air, e.g., primary and secondary, with the secondary being high above the fuel guns.

Combustion air is delivered at the secondary and tertiary levels by windboxes which are essentially large, box-like ducts that are mounted to and surround the outside wall of the combustion chamber. A windbox is a large box having a plurality of openings or ports in a furnace wall leading into the boiler's combustion chamber. Pressurized airflow is provided to the windboxes by a fan, and each windbox consequently functions as a plenum. These ducts operate as manifolds and feed air directly into the combustion chamber through a number of ports in the chamber's walls.

In the past, combustion air exiting secondary or tertiary windboxes into the combustion chamber did not always have sufficient velocity or momentum to mix with upwardly exiting furnace gases. In fact, poor penetration of combustion air tends to channel high temperature gases into the center of the furnace (a stack pattern) resulting in inefficient combustion of materials, poorer liquor recovery, a high level of chemical carryover, higher TRS/CO emissions and higher furnace flue gas exit temperatures. All of these things are undesirable in a black liquor recovery boiler, as they reduce the unit's capacity.

As noted above the lowest air nozzles in the furnace wall are called primary air nozzles. They are positioned level with the surface of the char bed and therefore molten and unburned material from the bed may penetrate into the nozzles. Conditions on the level of the primary air nozzles are also otherwise highly corrosive, which shortens the service life of the nozzles. Furthermore, even great quantities of molten material may unexpectedly flow out of the char bed against the furnace walls, and the penetration of the molten material into the nozzles exerts a high strain on the nozzles. As a result, the nozzles are burned and corrode easily and have to be replaced subsequently.

Existing nozzles are typically made of a tube welded to the pressure casing of the recovery boiler. In some eases, the nozzle is surrounded by a refractory material to prevent damage by smelt leakages. The refractory material is provided either on the edges of the nozzle and below it, or it surrounds the nozzle. A problem therewith is that the nozzle can be replaced only by detaching the entire nozzle structure from the boiler wall. To achieve working conditions in which the detachment of the nozzles from the welds can be done, the shut-down of the boiler is necessary. Another problem is that the detachment of the nozzles may damage the boiler tubing, as a result of which operational disturbances and tube damages may occur after the replacement. If the nozzle is attached to the wall tubes of the furnace by welding, damage to the nozzle usually also results in damages to the furnace wall tubes to which the nozzle is attached.

In the secondary and tertiary nozzles, air flow may be disrupted by numerous factors including structural discontinuities in the windbox and nozzle design and exit port interface. This can lead to inefficient air flow, and in some instances, to reflux of the gas within the boiler into the nozzle and a portion of the duct work; thereby raising the temperature in the area externally of the boiler and significantly shortening the life of the plenum structure.

BRIEF DESCRIPTION OF THE DRAWINGS

Apparatus embodying features of my invention are depicted in the accompanying drawings which form a portion of this disclosure and wherein.

DESCRIPTION OF THE PREFERRED EMBODIMENT

Figure 1:
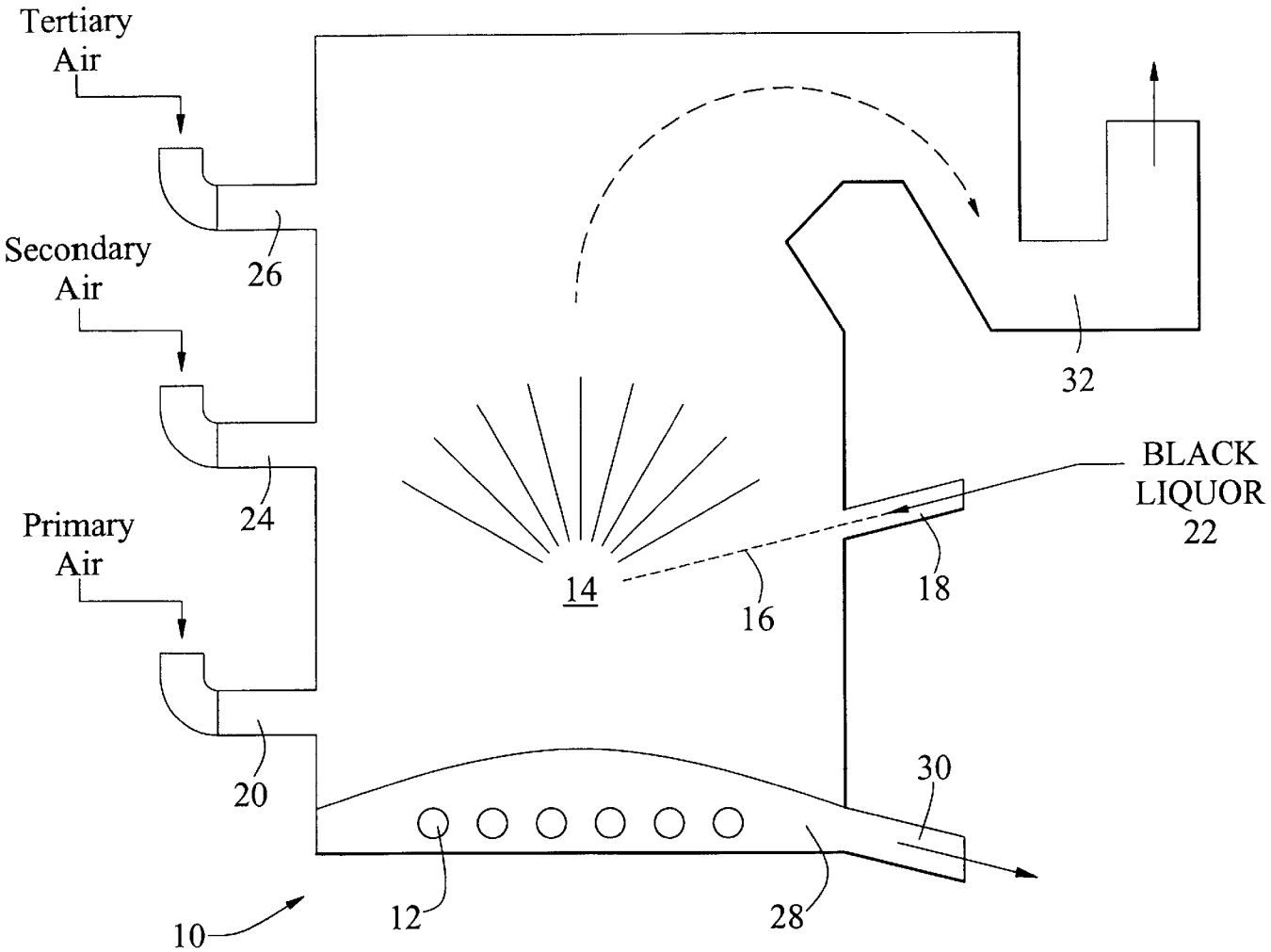
FIG. 1 is a side elevation of a representation of a boiler.

Referring to FIG. 1, there is shown a schematic side view of a recovery boiler 10. The recovery boiler 10 comprises a bed 12 over which a combustion zone 14 is located. Black liquor 22 enters into the boiler 10 through the fuel input spray. The liquor 22 is typically sprayed into the combustion zone 14 in the form of droplets 16 (greatly exaggerated). A plurality of air inputs are supplied to the boiler 10 using windboxes circumscribing the exterior of the boiler furnace. A primary windbox 20 supplies air to the boiler 10 which is closest to the bed 12. Secondary windbox 24 and tertiary windbox 26 supply air into the boiler 10 at further distances from the bed 12. The combustion of black liquor 22 and air in the combustion zone 14 creates the smelt 28 which is the molten state of the recovered chemical. The smelt 28 is drained from the boiler 10 via drain 30. In the recovery boiler 10, black liquor 22 is combusted with air from the primary windbox 20 in combustion zone 14, which is limited to a reduction zone. As the exhaust by-product of the combustion is released from the combustion zone 14, air from the secondary windbox 24 and tertiary windbox 26 further aid the combustion process to create an oxidizing atmosphere, leading to an eventual exhaust of the combustion byproducts through an exhaust output 32. It will be appreciated that the windbox arrangement shown may be varied as is well known in the art and a particular boiler may not include all air inputs or windboxes. In fact, the present invention may be used with bark-fired boilers as well as black liquor fired boilers, the invention pertaining essentially to the apparatus and method of controlling air flow to the furnace.

Figure 3:
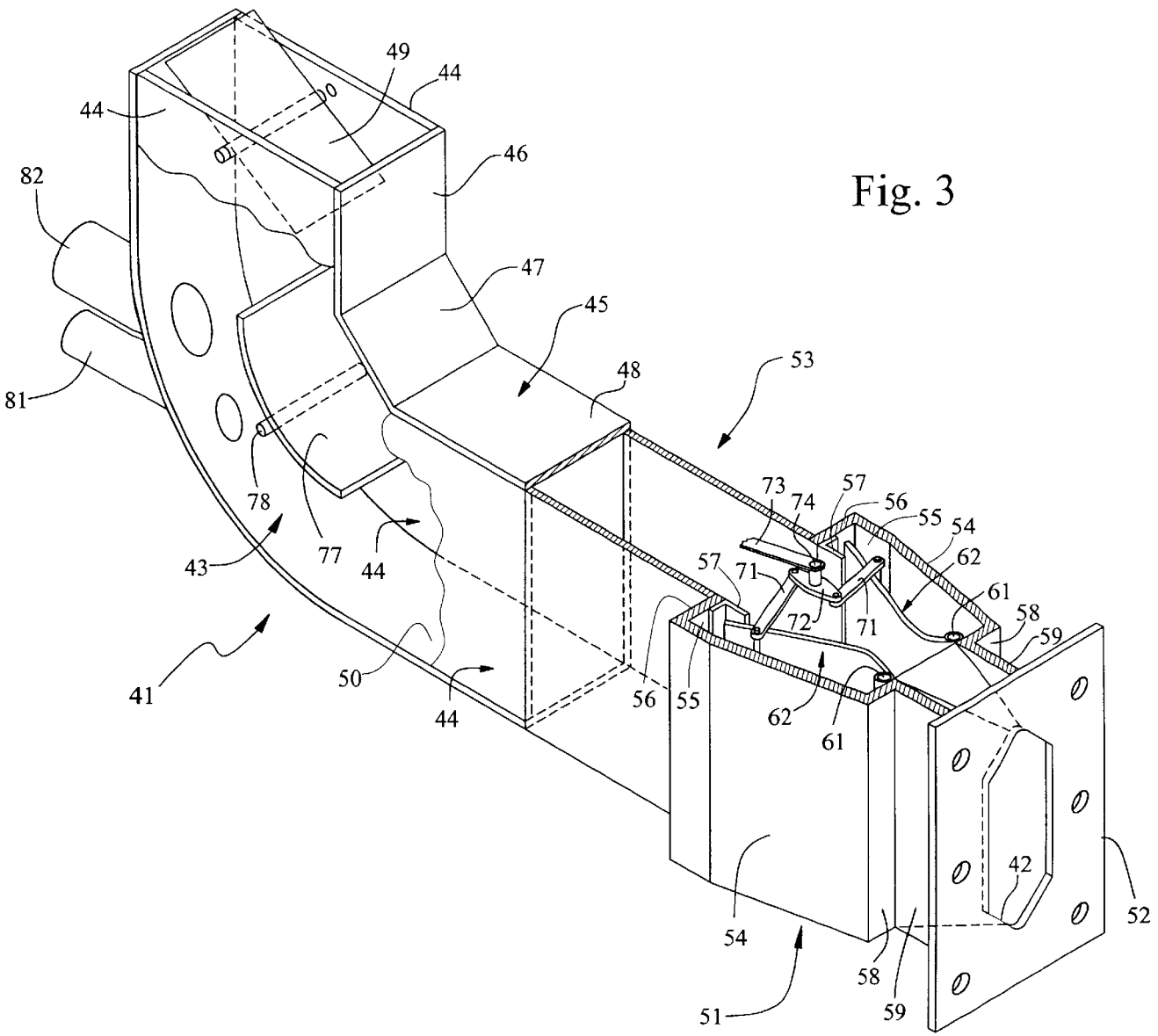
FIG. 3 is a plan view of the transition housing showing the internal components.

Referring to FIG. 3 it may be seen that the present invention requires the use of a plenum 41 extending from one of the air supply windboxes to a port 42 at one of the levels within the boiler furnace 10. Plenum 41 is defined in part by a curved wall section 43 and complementary side walls 44 which are affixed on either side of curved section 43. Plenum 41 is closed on top by a formed plate 45 including vertical section 46 and 47, and horizontal section 48. A butterfly or rotatable control damper 49 is mounted proximal the junction of plenum 41 with the associated windbox and serves as an isolation damper or volume damper. The lower portion of plenum 41 is substantially horizontally oriented and leads to port 42. It will be appreciated that a rodding port 81 and inspection port 82 may be incorporated into curved wall section 43 as shown for conventional use.

Figure 2:
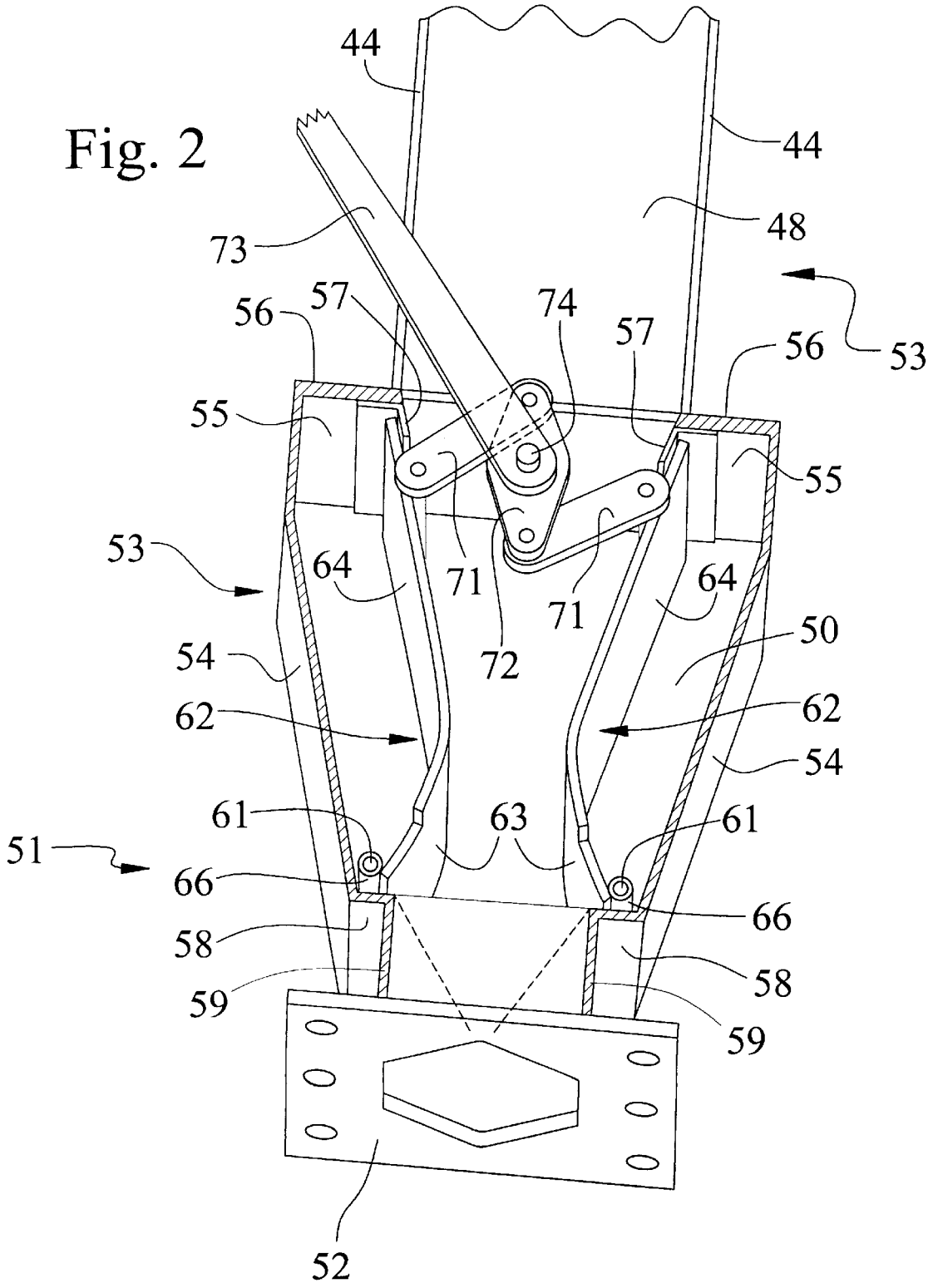
FIG. 2 is a perspective view of the plenum of the invention with the upper plate not shown to illustrate the dampers.

Looking at FIG. 2, a slightly convergent nozzle 51 is mounted within port 42 using a mounting plate 52 and a portion of plenum 41 configured as a transition housing 53. Transition housing 53 has its top defined by horizontal section 48 and its bottom defined by a bottom plate 50 of plenum 41, and thus has the same height as the lower portion of plenum 41; however, housing 53 has complementary outer walls 54 which define a wider space than the side walls 44 of plenum 41. Side walls 44 and outer walls 54 are connected by junction walls 56. A pair of opposed flanges 57 extend coplanar with side walls 44 nominally within housing 53 defining an internal vertical channel 55 on each side of housing 53 outwardly of the lower portion of plenum 41. Outer walls 54 converge from the area of channel 55 to proximal the mounting plate 52. In actual practice, an outer wall 54 and a junction wall 56 may be formed from a single plate by making a substantially right angle bend to define the junction wall, a second obtuse bend spaced from the first bend to create the convergence, a third bend to form a set back wall 58, parallel to junction wall 56 and a right angle bend to form a throat wall 59 extending away from junction wall 56 for attachment to mounting plate 52. Horizontal section 48 and bottom plate 50 are joined to the junction walls and outer walls to complete the enclosure of housing 53.

Within housing 53 and closely adjacent set back walls 58, are a pair of vertically aligned pivot shafts 61. Pivot shafts 61 support a pair of opposing damper foils 62, defined by arcuate portion 63 and a substantially linear portion 64. Arcuate portion 63 is formed proximal pivot shafts 61, with the end most portion of foil 62 including a sleeve 66 within which pivot shaft 61 is received. Sleeve 66 may be a tubular member attached to foil 62 or the foil may be formed to define the sleeve. In either case, the surface of foil 62 should be formed on the side of sleeve 66 opposite converging outer wall 54 and proximal throat wall 59. Foil 62 is substantially the same height as outer wall 54 and linear portion 64 extends. to proximal junction wall 56 such that it is confined laterally within internal channel 55.

Nozzle 51 extends through mounting plate 52 past throat walls 59 and terminates at proximal sleeve 66 such that the tangent line of sleeve 66 is adjacent nozzle 51, thereby maintaining the separation between foil 62 and nozzle 51 constant for all positions of the foil. As may be seen in FIG. 2, each foil 62 has a link 71 attached at one end thereof to the upper edge of linear portion 64 and attached at the other end to a dual lobe cam 72 such that as the cam rotates about a vertical axis, linear portions 64 of each foil are concomitantly moved toward and away from each other. The range of motion of the foils is limited by the width of inner channel 55. It may be seen that the arcuate portions 63 of foils 62, extend inwardly within housing 53 relative to sleeves 66 such that the area between the foils proximal the nozzle is variable. Further, the configuration of the foils is intended to induce laminar flow of the air relative to the vertical walls of the housing by providing a continuous curved surface with only a minimal separation between the foil and nozzle such that minimal turbulence is induced as the air crosses this boundary. The movable foils allow the throat area to be varied in accordance with the volume of air needed at the particular port; thus, the position of control damper 49 may be coordinated with the position of foils 62 to provide maximum effectiveness of air delivery through the nozzle. The position of the foils is varied using a governor arm 73 connected to a shaft 74 passing through section 48. The governor arm may be actuated in a number of different ways, including manually, electronically, or otherwise. Additionally, a direct drive mechanism, such as a servo motor, may be affixed to shaft 74 to move the cam and foils without the use of governor arm 73.

It should be further appreciated that curved section 43 significantly reduces turbulence inside plenum 41, and the addition of a curved turning vane 77 concentric with the radius of the curvature of curved section 43, which can be pivotally mounted within plenum 41 on pivoting rod 78, additionally directs the air flow toward port 42 and reduces the turbulence, all contributing to a laminar flow of air through the plenum and port. It should be noted that the position of the foils 62, damper 49, and vane 77 may be automated by sensing boiler conditions and adjusting air flow at the various ports using this invention in conjunction with known sensing and control mechanisms.

As may be noted, non-laminar flow or turbulent mixing of the air is induced by the air passing abrupt interfaces, creating eddies and voids. When such turbulence is induced, the air flow to the combustion chamber is sometimes inefficient, with the air stream dissipating in the natural updraft condition within the boiler prior to reaching the desired combustion region. Further, it is not uncommon for exit port turbulence and/or back pressure to be such that inefficient air flow through a port allows regurgitation of hot furnace combustion gases into the air delivery system, causing fouling and significantly reducing the life expectancy of the materials used due to thermal stress. By significantly reducing all discontinuities and providing a variable throat which can maintain air stream velocity at lower volumes, the present invention improves the efficiency of the boiler and increases the service life of the components.

While I have shown the invention in but one form, the foregoing disclosure is presented by way of illustration and is not intended to serve to limit the scope of the appended claims.

What is claimed is:

1. Register apparatus for facilitating a laminar flow of air from a distribution chamber associated with a boiler through at least one port in the walls of a combustion chamber in said boiler comprising:

a. an air feed distribution plenum connected to said distribution chamber said air feed distribution plenum defined in part by a curved wall;

b. an internal turning vane mounted within said air feed distribution plenum substantially concentric with said curved wall;

c. a transition housing mounted to said air feed distribution plenum;

d. opposing adjustable damper foils mounted within said transition housing and;

e. an exit nozzle mounted between said port and said air feed distribution plenum, said transition housing surrounding said damper foils and said exit nozzle, wherein said exit nozzele is cooperatively positioned to provide minimal separation between said damper foils and said exit nozzle to provide a transition for an air flow from said damper foils to said port.

2. Apparatus as defined in claim 1 wherein said damper foils are pivotally mounted along a pivot axis proximal said exit nozzles with said foils having a region of maximum curvature proximal said pivotal mounting for controlling the direction of the air flow.

3. Apparatus as defined in claim 2 wherein said pivot axis is on a side of said foil opposite said air feed distribution plenum.

4. Apparatus as defined in claim 2 wherein the tangent of the foil curve is minimally separated from said pivot axis.

5. Apparatus as defined in claim 1 wherein said turning vane comprises an arcuate sheet pivotally mounted concentric with said curved wall and displaced from said curved wall toward the center of curvature of said curved wall to reduce the air turbulence within said air feed distribution plenum.

6. Apparatus as defined in claim 1 further comprising an isolation damper mounted intermediate said distribution chamber and said air feed distribution plenum.

7. Apparatus as defined in claim 1 further comprising an actuating linkage operatively connected to each of said damper foils for effecting concomitant opposite movement of said foils.

8. Apparatus as defined in claim 7 wherein said actuating linkage comprises a dual lobe cam mounted for rotation about a central axis, rigid link bars pivotally connected to each lobe of said cam and to an adjacent damping foil at an end thereof opposite said port, and an actuating arm operatively connected to rotate said dual lobe cam.

9. An apparatus for improving the delivery airflow from a windbox to a combustion chamber of a boiler having at least one such windbox positioned in surrounding relationship relative to said combustion chamber, said apparatus comprising:

a. an air feed distribution plenum connected between said windbox and at least one port in communication with said combustion chamber, said air feed distribution plenum defined in part by a curved wall;

b. an internal turning vane mounted within said air feed distribution plenum substantially concentric with said curved wall;

c. a transition housing mounted to said air feed distribution plenum;

d. opposing adjustable damper foils mounted within said transition housing; and said transition housing surrounding said damper foils and said exit nozzel, wherein said nozzel is e. an exit nozzel mounted between said port and said air feed distribution plenum cooperatively positioned to provide minimal separation between said damper foils and said nozzel to provide a transition for an air flow from said damper foils to said port.

10. Apparatus as defined in claim 9 wherein said damper foils are pivotally mounted along a pivot axis within said exit nozzles with said foils having a region of maximum curvature proximal said pivotal mounting for controlling the direction of the air flow.

11. Apparatus as defined in claim 10 wherein said pivot axis is on a side of said foil opposite said exit nozzle.

12. Apparatus as defined in claim 10 wherein the tangent of the foil curve is minimally separated from said pivot axis.

13. Apparatus as defined in claim 9 wherein said turning vane comprises an arcuate sheet pivotally mounted concentric with said curved wall and displaced from said curved wall toward the center of curvature of said curved wall to reduce the air turbulence within said air feed distribution plenum.

14. Apparatus as defined in claim 9 further comprising an isolation damper mounted intermediate the windbox and said air feed distribution plenum.

15. Apparatus as defined in claim 9 further comprising an actuating linkage operatively connected to each of said damper foils for effecting concomitant opposite movement of said foils.

16. Apparatus as defined in claim 15 wherein said actuating linkage comprises a dual lobe cam mounted for rotation about a central axis, rigid link bars pivotally connected to each lobe of said cam and to an adjacent damping foil at an end thereof opposite said port, and an actuating arm operatively connected to rotate said dual lobe cam.

* * * * *